US008049627B1

(12) United States Patent
Addante

(10) Patent No.: US 8,049,627 B1
(45) Date of Patent: Nov. 1, 2011

(54) CONTAINER WITH REMOVABLE DATA STORAGE MECHANISM

(75) Inventor: Steve Addante, Cary, IL (US)

(73) Assignee: Walgreen Co., Deerfield, IL (US)

( * ) Notice: Subject to any disclaimer, the term of this patent is extended or adjusted under 35 U.S.C. 154(b) by 359 days.

(21) Appl. No.: 12/205,528

(22) Filed: Sep. 5, 2008

(51) Int. Cl.
*B65D 1/02* (2006.01)
*B60R 25/00* (2006.01)

(52) U.S. Cl. ..... 340/572.8; 215/40

(58) Field of Classification Search ..... 340/10.1, 340/572.1–572.8; 215/40
See application file for complete search history.

(56) References Cited

U.S. PATENT DOCUMENTS

| | | | | |
|---|---|---|---|---|
| 5,942,978 | A | 8/1999 | Shafer | |
| 5,947,256 | A * | 9/1999 | Patterson | 194/209 |
| 6,025,780 | A | 2/2000 | Bowers et al. | |
| 6,429,776 | B1 | 8/2002 | Alicot et al. | |
| 6,724,308 | B2 | 4/2004 | Nicholson | |
| 7,098,794 | B2 | 8/2006 | Lindsay et al. | |
| 7,775,205 | B2 * | 8/2010 | Edgerley | 128/203.21 |
| 7,839,288 | B2 * | 11/2010 | Wang et al. | 340/572.8 |
| 2002/0188259 | A1 | 12/2002 | Hickle et al. | |
| 2003/0099158 | A1 * | 5/2003 | De la Huerga | 368/10 |
| 2006/0061475 | A1 | 3/2006 | Moskowitz et al. | |
| 2006/0118229 | A1 | 6/2006 | Ohashi et al. | |
| 2006/0131391 | A1 | 6/2006 | Penuela | |
| 2006/0132313 | A1 | 6/2006 | Moskowitz | |
| 2006/0152367 | A1 | 7/2006 | Narayanaswamy | |
| 2006/0181414 | A1 | 8/2006 | Bandy et al. | |
| 2006/0214791 | A1 | 9/2006 | Tethrake et al. | |
| 2008/0012687 | A1 * | 1/2008 | Rubinstein | 340/10.1 |
| 2008/0245791 | A1 * | 10/2008 | Atherton | 220/200 |
| 2008/0302807 | A1 * | 12/2008 | Ungrady et al. | 220/745 |
| 2008/0308518 | A1 * | 12/2008 | Sprishen | 215/40 |
| 2010/0059597 | A1 * | 3/2010 | Iyengar et al. | 235/492 |

* cited by examiner

*Primary Examiner* — Benjamin C Lee
*Assistant Examiner* — Sigmund Tang
(74) *Attorney, Agent, or Firm* — Francis C. Kowalik; Marshall, Gerstein & Borun LLP

(57) ABSTRACT

A container may be formed with a pocket to securely receive a tag, such as a radio-frequency identification tag. The tag is secured within the pocket such that it remains within the pocket during ordinary use and handling of the container, but it is substantially completely removable from the pocket without tools or solvents.

11 Claims, 2 Drawing Sheets

CONTAINER WITH REMOVABLE DATA STORAGE MECHANISM

TECHNICAL FIELD

The present disclosure generally relates to data storage, and more particularly, to a data storage mechanism that stores information associated with a container to which it is attached.

BACKGROUND

Data storage mechanisms such as radio-frequency-identification (RFID) chips are well known and widely used to control and secure inventory, facilitate point of sale transactions, identify and locate equipment and personnel within a facility or area, collect fares or tolls, facilitate ticketed entry into events, and numerous other things. Virtually any application that requires location determination and/or tracking and/or data transfer can be accomplished using RFID technology.

In inventory applications, such as those employed in retail facilities, RFID technology facilitates sales transactions and provides product security. Product security applications, particularly those at retail facilities, require that the RFID chip is disabled to prevent alarm activation upon removal of a product from a secured area of the facility. Typically, the RFID chip is disabled by exposing it to a magnetic or electric field. The chip may alternatively be disabled by physically damaging some portion of the chip, such as its antenna. To prevent unauthorized individuals from damaging the RFID chip to defeat the security system, for example, such chips are often positioned on the product in a manner that limits access thereto.

As an alternative to disabling the RFID chip to circumvent security measures, the security measures may be circumvented by actually removing the chip from the product. To prevent a would-be thief from removing the chip himself/herself, removal typically requires the use of a specially designed tool. Failure to use the special tool results in damage or failure of the chip and concurrent activation of a secondary security device, for example, such as the spilling of a dye onto the product. Removable chips are most frequently seen providing inventory security in retail clothing establishments and include a body portion in which the RFID chip is embedded. The body portion also includes a pin or stake that pierces through a portion of the clothing and is secured by a locking member.

Thus, typical security/tracking measures using RFID chips are either adapted to be securely attached to the product and electrically/magnetically disabled, or they are adapted to be removed using a special tool. These configurations have the obvious advantage that most potential thieves do not enter the facility with an appropriate electric/magnetic field generator and/or a specialized removal tool.

Unless removed, all or a substantial portion of the chip remains with the product after a sale transaction occurs. Thus, any information stored on the chip, unless disabled, can potentially be accessed, tracked, etc. Some consumers do not want any portion of the RFID chip to remain with the product after the sale. Moreover, pin-type removable chips are not suitable for products that include hard packaging.

SUMMARY

One aspect of the present disclosure is directed to a tag assembly that is secured to, but substantially completely removable from, a container. That is, a modest amount of force, that which may be supplied by a user grasping and pulling on a tab of the tag assembly, causes the tag assembly to lift and separate from the container such that the entire tag assembly may be removed from the container. Ideally the tag assembly is substantially entirely removed from the container with no evidence remaining on the container that the tag assembly was ever affixed or secured to the container.

As mentioned, the tag assembly may be formed with a tab to facilitate the prying or lifting motion necessary to remove the tag assembly from the container. The tab may have a portion that can be lifted away from a surface of the container to which the tag assembly is attached, grasped, and pulled by a user to remove the tag assembly. The portion may include a raised or "dog eared" portion extending away from a surface of the tag assembly and/or a surface of the container to facilitate no that the user attempting to remove the tag assembly from the container may insert a portion of a fingernail, pen tip, pencil tip, or other suitable tool or device between the tab and the surface to lift the tab and eventually lift the tag assembly itself away from the surface so as to remove the tag assembly from the surface and hence the container.

Low tack adhesive, friction, or other such methods of attachment to secure the tag assembly to the container allows the tab to be user removable from the container without tools and without leaving portions of the tag assembly or residue remaining on the product.

DETAILED DESCRIPTION

Counter to the generally accepted principle that an RFID chip used for product inventory control or security should be securely affixed or attached to a product such that it is not easily removed without special tools or without the chip becoming damaged and portions of the chip remaining on the container, one chip constructed in accordance with the present disclosure may be secured within a tag assembly that is connected to a container or product in a manner that the tag assembly is easily and substantially completely removable.

Figure 1:
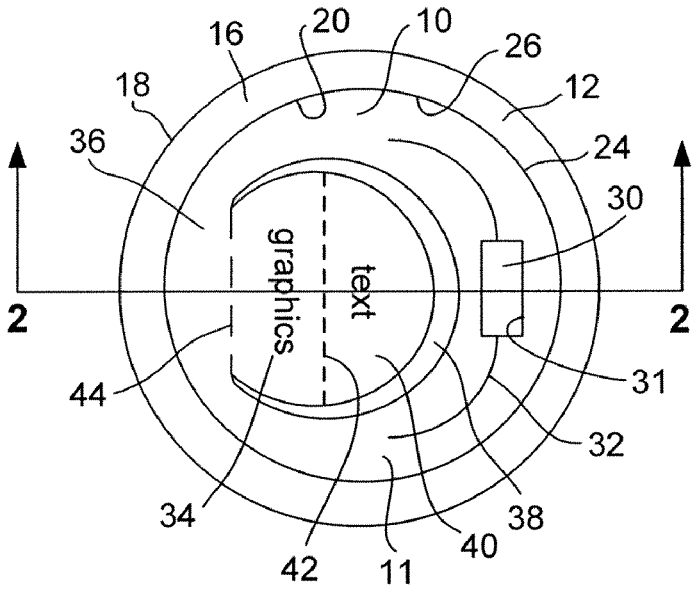
FIG. 1 is an end view of a container including a tag assembly constructed in accordance with various embodiments of the disclosure.
Figure 2:
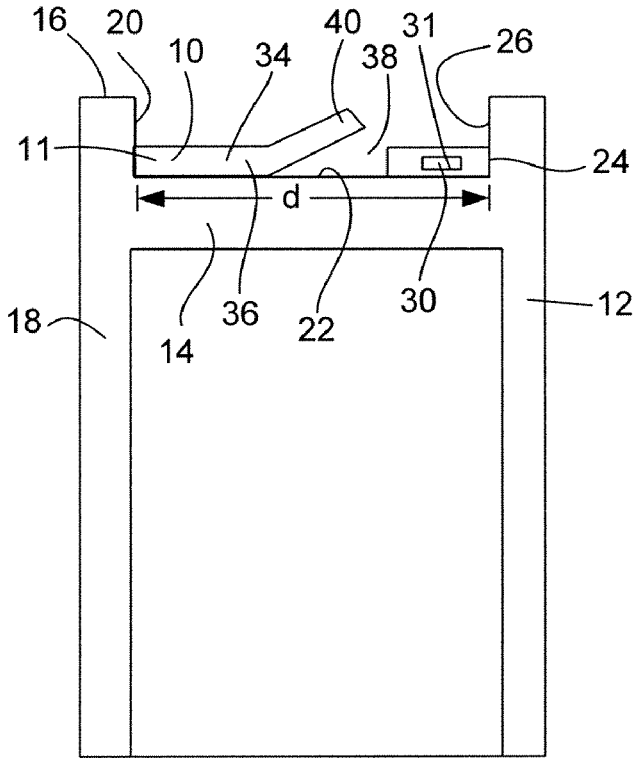
FIG. 2 is a cross-sectional view taken along line 2-2 of FIG. 1.

For example, FIGS. 1 and 2 depict a container 12 and a tag assembly 10 removably connected to the container 12. The container 12 has a right circular cylindrical configuration and the tag assembly 10 has a circular configuration. The container 12 may have virtually any cross-sectional configuration, such as square, rectangular, oval, etc., with the tag assembly 10 having a corresponding shape. The tag assembly may alternatively be a different shape than the cross-sectional configuration of the container 12. For example, the cross-section of the container 12 may be circular and the tag assembly 10 may be rectangular. Other geometric configurations are also contemplated. Furthermore, while the container 12 is shown to have the configuration of a pill bottle typically used in the distribution of pharmaceuticals, the container 12 may include any type of packaging within which a product or a further packaged product is contained, e.g., external packaging, a lid for a container such as a pill bottle lid, or within a portion of the product itself, e.g., a housing member for a product. Thus, the term container, while having a normally understood meaning, is used herein to include that meaning and also have a broader meaning encompassing all of the foregoing kinds and types of products and product packaging.

As depicted, the container 12 is formed with an end wall 14 recessed relative to an edge 16 of a side wall 18 to define a lip 20. The lip 20, a side wall portion 26, and the end wall 14 form a recess in the container 12, which is referred to herein as a pocket 22, with a diameter "d." The tag assembly 10 is sized to be securely disposed within the pocket 22, as will be described in more detail.

The tag assembly 10 of the presently disclosed embodiment comprises a platform 11 and a data storage mechanism 30. The platform 11 comprises a one-piece disc-shaped structure constructed of a plastic, for example, and has a peripheral surface 24. That is, the peripheral surface 24 extends about the entire perimeter of the platform 11. In alternative embodiments, however, the peripheral surface 24 may extend only about a portion of the perimeter of the platform 11. In the disclosed embodiment, the peripheral surface 24 has substantially the same diameter "d" as the pocket 22 in the container 12. In another embodiment, the peripheral surface 24 can have a diameter that is slightly larger than the diameter "d." So configured, when disposed within the pocket 22, the peripheral surface 24 frictionally engages the side wall portion 26 of the pocket 22, thereby securely connecting the tag assembly 10 to the container 12. Under normal conditions of stocking and handling the container 12, the tag assembly 10 remains secured within the pocket 22 and connected to the container 12. However, in a preferred embodiment, a clerk, customer, or other user may substantially completely remove the tag assembly 10 from the pocket 22 without using any special tools or solvents, and without leaving any substantial portion of the tag assembly 10 connected to the container 12. In one embodiment, the side wall portion 26 of the container 12 can include one or more ribs, protrusions, or other retention devices, to mechanically fix the tag assembly 10 within the pocket 22. The mechanical fixation and replace or assist the frictional retention.

As mentioned, the disclosed embodiment of the tag assembly 10 includes the data storage mechanism 30. In the present embodiment, the data storage mechanics comprises an RFID chip 30. When the tag assembly 10 includes the RFID chip 30, it also preferably includes an antenna 32 (shown in FIG. 2) coupled to the chip 30. In the disclosed embodiment, the RFID chip 30 is disposed within a cavity 31 formed in the platform 11 of the tag assembly 10, and the antenna 32 is embedded within the platform 11. In one embodiment, the RFID chip 30 and the antenna 32 are formed directly in the platform 11 during an injection molding process, for example, or some other suitable manufacturing process. In another embodiment, the RFID chip 30 and antenna 32 can be disposed and secured within a recess formed in the platform 11 after the platform 11 is manufactured. In still another embodiment, the RFID chip 30 and antenna 32 can be simply glued or otherwise secured to an outer surface of the platform 11 after the platform 11 is manufactured. While the antenna 32 is depicted in FIG. 2 as extending away from the RFID chip 30, in alternative embodiments, the antenna 32 can be inside of the RFID chip 30.

The RFID chip 30 may operate in accordance with virtually any suitable RFID protocol with the antenna 32 being accordingly specified. The particular RFID protocol(s) under which the chip 30 operates is not material to the instant invention. In fact, in one embodiment, the data storage mechanism 30 of the tag assembly 10 may not necessarily include an RFID chip. Instead, the tag assembly 10 may simply include a dummy platform 11, which suggests the presence of an RFID chip without any data storage mechanism. In other embodiments, the data storage mechanism 30 may contain printed or coded data in another format, such as a bar code or the like, printed on the platform 11, or may simply contain text and/or graphics printed on the platform 11. For example, in one embodiment, the tag assembly 10 may comprise a point-of-sale coupon that carries data that can be scanned by a bar code reader, for example, or text that can be manually entered into a kiosk or sales terminal to obtain a paper coupon or electronic discount. To prevent re-use of such a coupon, or to provide audit tracking or the like, a sales clerk may remove the tag assembly 10 easily, substantially, and completely, without the use of tools or the like.

As mentioned, the tag assembly 10 includes the platform 11 that is adapted to be connected to the container 12. In the disclosed embodiment, the platform 11 includes a body portion 36 and a tab 34. The tab 34 facilitates removal of the tag assembly 10 from the container 12. The tab 34 may be a portion separated from the body portion 36 of the platform 11. For example, as shown in FIG. 1, the tab 34 may be cut from the body portion 36 leaving a small gap 38 between the body portion 36 and the tab 34. During removal, a user may insert a fingernail, a tip of a pencil, tip of a pen, or some other suitable object into the gap 38 to initiate lifting of the tab 34. Once the tab 34 is slightly raised from its stored position, the user can grasp the tab 34 and pull it to remove the tag assembly 10 from the pocket 22 of the container 12. In FIG. 1, the tab 34 is shown to have a partially circular configuration, but any suitable configuration may be used, such as square, rectangular, triangular, elliptical, and the like.

In one embodiment, which is illustrated in FIG. 2, the tab 34 may further be formed with a raised or dog eared portion 40. The raised portion 40 makes it even easier for user to grasp the tab 34 to affect removal of the tag assembly 10 from the container 12. Prior to a user removing the tag assembly 10, the raised portion 40 of the tab 34 is preferably retained within the pocket 22. That is, preferably the raised portion 40 does not extend away from the container 12 to such an extent that it extends out of the pocket 22 beyond the edge 16 of the side wall 18 of the container 12. So configured, the raised portion 40 will not interfere with storing the container on a shelf, for example, or stacking multiple containers, etc. FIG. 1 illustrates first and second phantom lines 42, 44, whereby the raised portion 40 may start at the first phantom line 42, and, during removal, the tab 34 may bend at the second phantom line 44.

Figure 3:
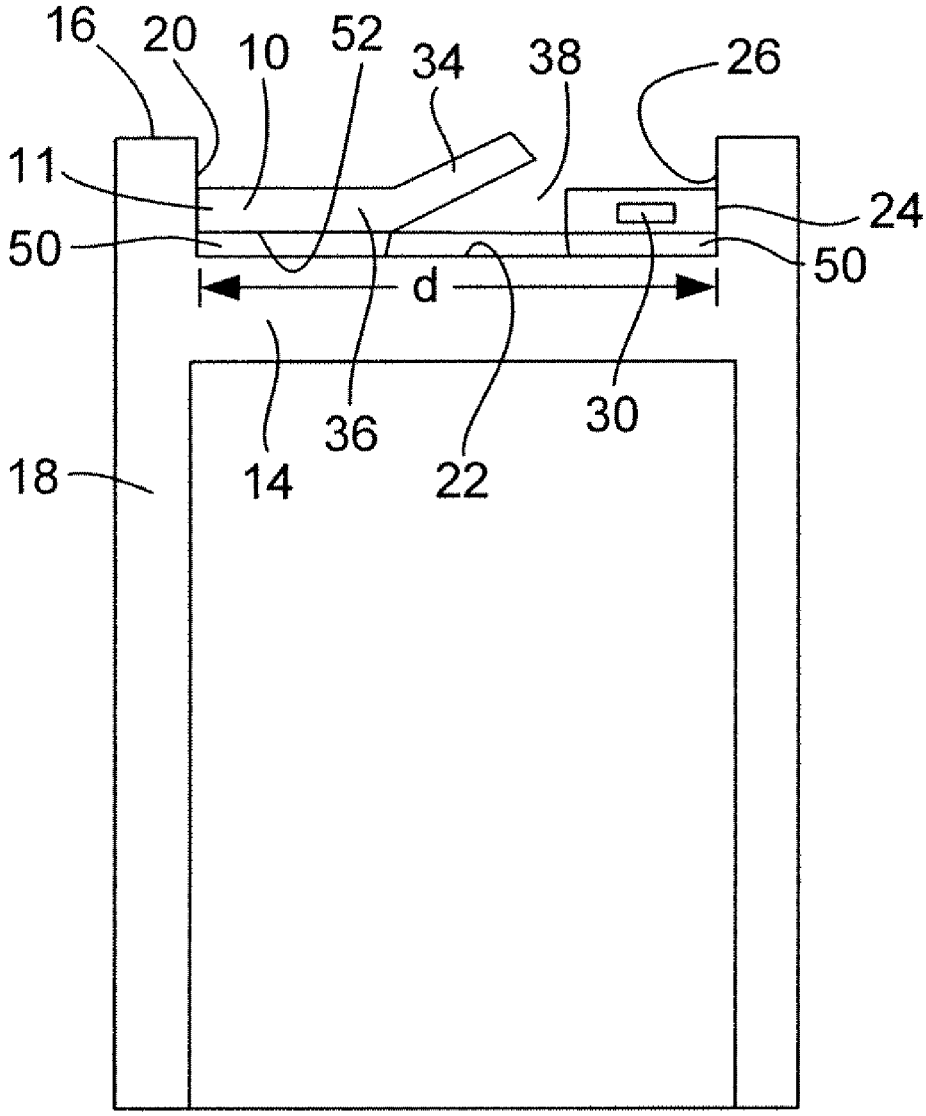
FIG. 3 is a cross-sectional view similar to FIG. 2, but illustrating an alternative embodiment of the disclosure.

FIG. 3 illustrates an alternative embodiment of the present disclosure. Like reference numerals are used to designate the same or similar structural elements described in connection with the embodiment described above. It will be appreciated that the various features and advantages of the embodiments described herein are interchangeable with each other, and therefore, because one feature is described in connection with a single embodiment should not be interpreted to mean the feature may not be used in connection with any or all of the other embodiments.

As shown in FIG. 3, this alternative embodiment includes an adhesive layer 50 securing the tag assembly 10 within the recess or pocket 22 of the container 22. In this embodiment, the peripheral edge 24 of the platform 11 of the tag assembly 10 may or may not frictionally engage the side wall portion 26 of the side wall 18 of the container 12. Moreover, in this embodiment, the side wall portion 26 may or may not include one or more ribs, protrusions, or other retention devices, for mechanically fixing the tag assembly 10 into the pocket 22. The adhesive layer 50 is disposed between a bottom surface 52 of the platform 11 of the tag assembly 10 and the end wall 14 of the container 12, and therefore, can be generally disc-shaped, shaped like an annular washer, or the like. One advantage of the adhesive layer 50 being shaped like an annular washer is that it allows a user to digitally penetrate the gap 38 in the platform 11 to pull the tab 34 without collecting adhesive on his/her finger, for example. In a preferred embodiment, the adhesive layer 50 comprises a low tack adhesive substantially permanently applied to the bottom surface 52 of the platform 11 of the tag assembly 10. So configured, virtually no adhesive remains stuck to the container 12 upon removal of the tag assembly 10 from the pocket 22.

The adhesive layer 50, the frictional engagement, the ribs or protrusions, or a combination thereof may therefore be used to secure the platform 11 of this embodiment within the pocket 22, thereby connecting the tag assembly 10 to the container 12. While the adhesive layer 50 of the disclosed embodiment includes a disc-shaped layer disposed between the bottom surface 52 of the platform 11 and the end wall 14 of the container 12, in alternative embodiments, the adhesive layer 50 can include a ring of adhesive, resembling maybe a hollow cylinder, that is disposed between the peripheral surface 24 of the platform 11 and the side wall portion 26 of the container 12. In such an embodiment, the peripheral surface 24 would preferably have a diameter smaller than the diameter "d" of the pocket 22.

While the tag assembly 10 of each embodiment has thus far been described as being secured within a pocket 22 formed in an end of a container 12, the pocket 22 need not be formed at the end of the container 12, but may be formed in the side wall 18, a cap member (not shown) for the container 12, or at any other suitable location. Furthermore, the container 12 may comprise packaging for a product, or may form a part of the product itself. Thus, while described herein as a container, one will appreciate that the pocket 22 may be formed in a product container, product packaging, the product itself, or any other suitable device that may include a tag assembly 10.

Based on the foregoing, it should be appreciated that the tag assembly 10 can be removably connected to the container 12. As such, the connection between the tag assembly 10 and the container 12 can be broken by a user using only a moderate level of force. The connection may therefore be referred to herein as a "frangible" connection. In some embodiments, this "frangible" connection may not be intended to be re-established after it is broken. For example, with certain adhesives such as silicone, for example, once the adhesive connection between the tag assembly 10 and the container 12 is broken, it cannot be re-established without introducing additional adhesive. In other embodiments, however, the "frangible" connection may be re-established after it is broken. This may be the case when the connection is established with friction and/or ribs, protrusions, etc., as described hereinabove, or with an adhesive connection that includes an adhesive layer 50 constructed of an adhesive that enables re-connection. For example, in one embodiment, the adhesive layer 50 could include a hook-and-loop fastener such as Velcro® that would enable re-connection of a previously broken connection.

One application of the tag assembly 10 described herein is in the field of pharmaceuticals. For example, a prescription container such as a pill bottle could be formed to include a recess such as the pocket 22 described herein for containing a tag assembly 10 equipped with the RFID chip 30 or bar code. The RFID chip 30 or bar code can include patient information, drug information, etc. associated with the specific pill bottle. Therefore, prior to filling a prescription, an appropriate reader can read the information stored on the RFID chip 30 or bar code, and indicate the same to the pharmacist or other technician that is tasked with filling the prescription. For example, the reader can indicate the name of the patient, the age of the patient, the name of the drug or medicament prescribed, and the quantity of the drug or medicament prescribed. A reader may also be configured to reference an Electronic Product Code (EPC) to identify particular items. The pharmacist or technician can then easily fill the container by picking the appropriate prescription. Once the container is filled, the container can be placed on a shelf, for example, until the patient arrives to pick up the prescription. Upon pick-up, the pharmacy or technician can once again have the RFID chip or bar code read to match the prescription with the individual picking up the prescription.

One advantage of utilizing the tag assembly 10 disclosed herein as the device for carrying the RFID chip or bar code on the prescription container is that it enables the RFID chip or bar code to be easily removed from the container. Some patients may have concerns over the security of the information stored on the RFID chip or bar code. For example, some patients may wonder if third-party bar code or RFID readers can freely obtain the patient's name, age, prescription information, etc. Therefore, to alleviate patient concern, for example, the tag assembly 10 of the present disclosure advantageously enables the pharmacist or technician to break the frangible connection between the tag assembly 10 and the container 12 to remove the RFID chip and/or bar code therefrom leaving no evidence that the RFID chip or bar code were ever on the container. Alternatively, the patient himself/herself can remove the tag assembly 10, if desired.

While particular embodiments of the present invention have been illustrated and described, it will be apparent to those skilled in the art that various changes and modifications can be made without departing from the spirit and scope of the invention. It is therefore intended to cover in the appended claims all such changes and modifications that are within the scope of this invention.

I claim:

1. A device for storing prescriptions, the device comprising:

a container including a curved sidewall and an end wall closing one end of the container, the sidewall and the end wall defining a recess on one side of the end wall and a container volume on the opposite side of the end wall;

a platform disposed within the recess abutting the end wall and defining a tab to be grasped by a user to remove the platform from the recess;

a frangible connection between the platform and the container, the frangible connection securing the platform in the recess until removed by the user;

an RFID chip carried by the platform and storing readable information associated with the container.

2. The device of claim 1, wherein the frangible connection comprises friction generated between the platform and the container.

3. The device of claim 1, wherein the frangible connection comprises an adhesive disposed between the platform and the container.

4. The device of claim 1, wherein the tab portion comprises a raised portion, the raised portion being displaced away from the container.

5. A prescription medicament container comprising:

A curved side wall;

an end wall closing one end of the container;

a recess defined on one side of the end wall and a container volume defined on an opposite side of the end wall;

a tag assembly disposed in the recess abutting the end wall and carrying patient information associated with the prescription medicament container, wherein the tag assembly includes an RFID chip and a tab for grasping by a user; and a frangible connection between one of the sidewall and the curved end wall and the tag assembly, the frangible connection securing the tag assembly including the patient information to the container until a user removes the tag assembly from the recess.

6. The container of claim 5, wherein the frangible connection comprises friction generated between the platform and the curved side wall.

7. The container of claim 5, further comprising an adhesive layer disposed between the platform and the end wall to define the frangible connection.

8. The container of claim 5, wherein the platform defines a tab portion to be grasped by a user to break the frangible connection and remove the tag assembly from the recess.

9. The container of claim 8, wherein the tab portion comprises a raised portion, the raised portion being displaced away from the curved end wall of the container.

10. A method of manufacturing a prescription storage container including a removable data storage mechanism, the method comprising:

forming the storage container to include a curved side wall and an end wall defining a recess on one side of the end wall and a container volume on the opposite side of the end wall;

forming a platform to fit within the recess of the storage container and to abut the end wall, and defining a tab to be grasped by a user to remove the platform from the recess;

connecting an RFID chip with a data storage mechanism to the platform;

storing prescription information on the data storage mechanism;

disposing the platform in the recess of the storage container to establish a frangible connection between the platform and the container.

11. The method of claim 10, wherein disposing the platform in the recess comprises at least one of (a) friction fitting the platform into the recess, (b) adhering the platform into the recess, and (c) mechanically fixing the platform into the recess.

* * * * *